US012648596B1

(12) United States Patent
Leacock

(10) Patent No.: US 12,648,596 B1
(45) Date of Patent: Jun. 9, 2026

(54) CARNIVAL PANTYHOSE

(71) Applicant: Nicolette Leacock, New Providence, PA (US)

(72) Inventor: Nicolette Leacock, New Providence, PA (US)

( * ) Notice: Subject to any disclaimer, the term of this patent is extended or adjusted under 35 U.S.C. 154(b) by 0 days.

(21) Appl. No.: 19/305,662

(22) Filed: Aug. 20, 2025

(51) Int. Cl.
*A41B 11/14* (2006.01)
*A41B 11/00* (2006.01)

(52) U.S. Cl.
CPC ..... *A41B 11/14* (2013.01); *A41B 11/00* (2013.01); *A41B 11/146* (2013.01)

(58) Field of Classification Search
CPC ..... A41B 11/14; A41B 11/00; A41B 11/146
See application file for complete search history.

(56) References Cited

U.S. PATENT DOCUMENTS 4,400,832 A * 8/1983 Kinder ..... A41B 9/08 128/100.1
4,920,769 A * 5/1990 Rickerl ..... A41B 9/004 2/406
5,023,957 A * 6/1991 Harvey ..... A41B 11/14 66/177
2010/0192285 A1* 8/2010 Ahn ..... A41B 11/14 2/243.1
2011/0191944 A1* 8/2011 Lescom ..... A41F 11/12 2/335

* cited by examiner

*Primary Examiner* — Khaled Annis
(74) *Attorney, Agent, or Firm* — Ruben Alcoba, Esq.

(57) ABSTRACT

A carnival pantyhose for Caribbean and Brazilian carnival costumes that includes two leg portions joined at a high-rising waistband, which defines front and rear wedge-shaped cut-outs extending toward the perineal region, and two wedge-shaped lateral portions extending above the hips to a position at or just below the inframammary region. Each wedge-shaped lateral portion terminates in an opening that allows a strip of the carnival costume to pass through, enabling removable attachment without sewing, stitching, fasteners, or modification of the carnival costume. The carnival pantyhose spans the outer side of the legs, hips, and lateral sides of the upper torso while leaving the front and rear torso areas corresponding to the cut-outs uncovered, preserving carnival costume aesthetics. Made of stretchable material, it conforms to varied body shapes and maintains positional stability. Optional fasteners, such as safety pins, may reinforce attachment to the carnival costume.

3 Claims, 2 Drawing Sheets

CARNIVAL PANTYHOSE

BACKGROUND

The present disclosure relates to carnival pantyhose designed for use with Caribbean and Brazilian carnival costumes, collectively referred to hereinafter as carnival costumes. Carnival costumes are typically elaborate and highly decorative, often incorporating feathers, sequins, beads, rhinestones, and other ornamental elements that create vibrant and visually striking ensembles. Performers rely on both the aesthetic and functional integrity of these costumes to deliver dynamic performances during carnival parades, competitions, and shows. Traditional pantyhose are generally designed for everyday or formal wear and often fail to accommodate the unique requirements of carnival costumes. When worn with such costumes, conventional pantyhose may interfere with decorative features, obscure important visual elements, or create unintentional lines and seams that detract from the intended visual effect.

Furthermore, existing designs for use with carnival costumes frequently require sewing, stitching, clips, pins, or other fasteners to secure them in place when worn with complex carnival costumes. These attachment methods can damage the delicate materials of the carnival costume, alter its original design, or require modifications that are both time-consuming and costly. They also may reduce the comfort and range of motion for performers, whose movements are central to the visual impact and effectiveness of carnival presentations. The reliance on fasteners or sewing may also lead to instability during wear, causing the pantyhose to shift, sag, or otherwise fail to maintain their intended position, which can compromise both the appearance and functionality of the carnival costume.

Another challenge arises from the wide variety of body shapes and sizes among performers. Conventional pantyhose may not adequately accommodate such variations, resulting in poor fit, discomfort, and inconsistent appearance. These limitations underscore the need for a carnival pantyhose design that not only adapts to varied body shapes but also maintains positional stability during high-energy performances.

Consequently, there exists a demand for a carnival pantyhose that achieves seamless integration with carnival costumes through both its intrinsic structural design and its removable attachment means. Such a carnival pantyhose should preserve the aesthetic integrity of the carnival costume, avoid interference with decorative elements, and provide comfort, flexibility, and stability for the performer. By addressing these issues, the carnival pantyhose disclosed herein enhances the overall visual and functional effectiveness of carnival costumes while minimizing the risk of damage or modification to the original design.

SUMMARY

The primary objective of the present invention is to provide a carnival pantyhose that achieves improved integration with carnival costumes by combining a purpose-designed pantyhose structure with removable attachment means, without requiring sewing, stitching, separate fasteners, or modifications to the original design of the carnival costume.

The invention accomplishes this by providing a carnival pantyhose comprising two leg portions joined at a high-rising waistband, which defines front and rear wedge-shaped cut-outs extending toward the perineal region. The carnival pantyhose further includes wedge-shaped lateral portions extending above the corresponding hips and upward to a position at or just below the inframammary region, each terminating in a lateral apex forming an opening. The carnival pantyhose is removably attached to the carnival costume by passing a strip of the carnival costume through each opening, while its design-including its high-rising waistband with its wedge-shaped cut-outs and lateral portions-ensures conformity to the body and visual integration with the carnival costume.

The carnival pantyhose is configured to cover the outer side of the legs, the hips, and the lateral sides of the upper torso, leaving the front and rear areas corresponding to the wedge-shaped cut-outs unobstructed, thereby avoiding aesthetic interference with the carnival costume. The carnival pantyhose is made from a stretchable material that enables conformity to varied body shapes while maintaining positional stability during use. Optional embodiments include reinforcing fasteners such as safety pins along marginal edges of the wedge-shaped cut-outs, slightly arcuate cut-out designs, and openings formed by either flexible bands or rigid loops.

BRIEF DESCRIPTION OF THE DRAWINGS

These and other features, aspects, and advantages of the present invention will become better understood with regards to the following description, appended claims, and drawings where:

DESCRIPTION

Figure 1:
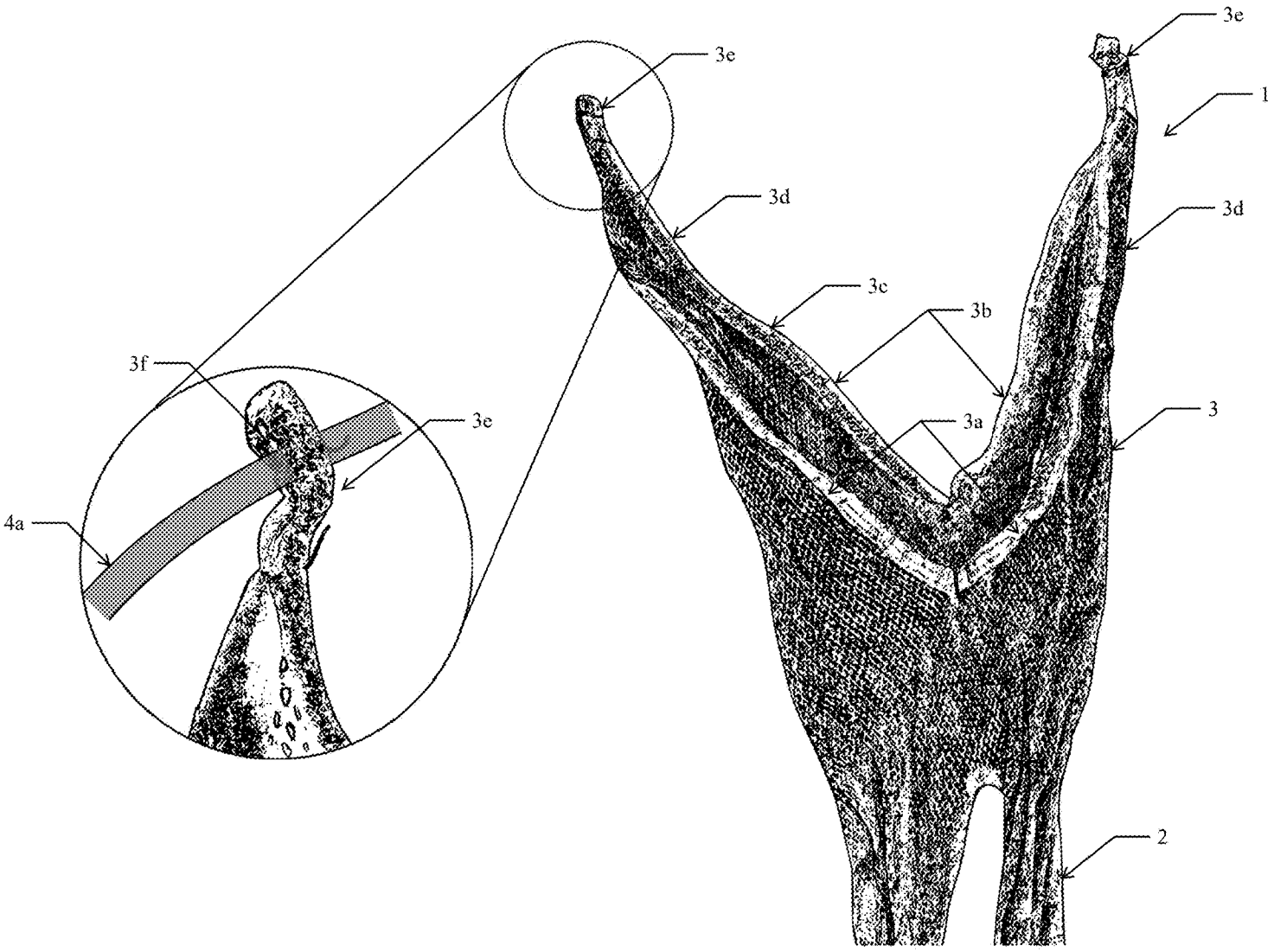
FIG. 1 is a perspective view of the present invention and a zoomed in view of the lateral apex.
Figure 2:
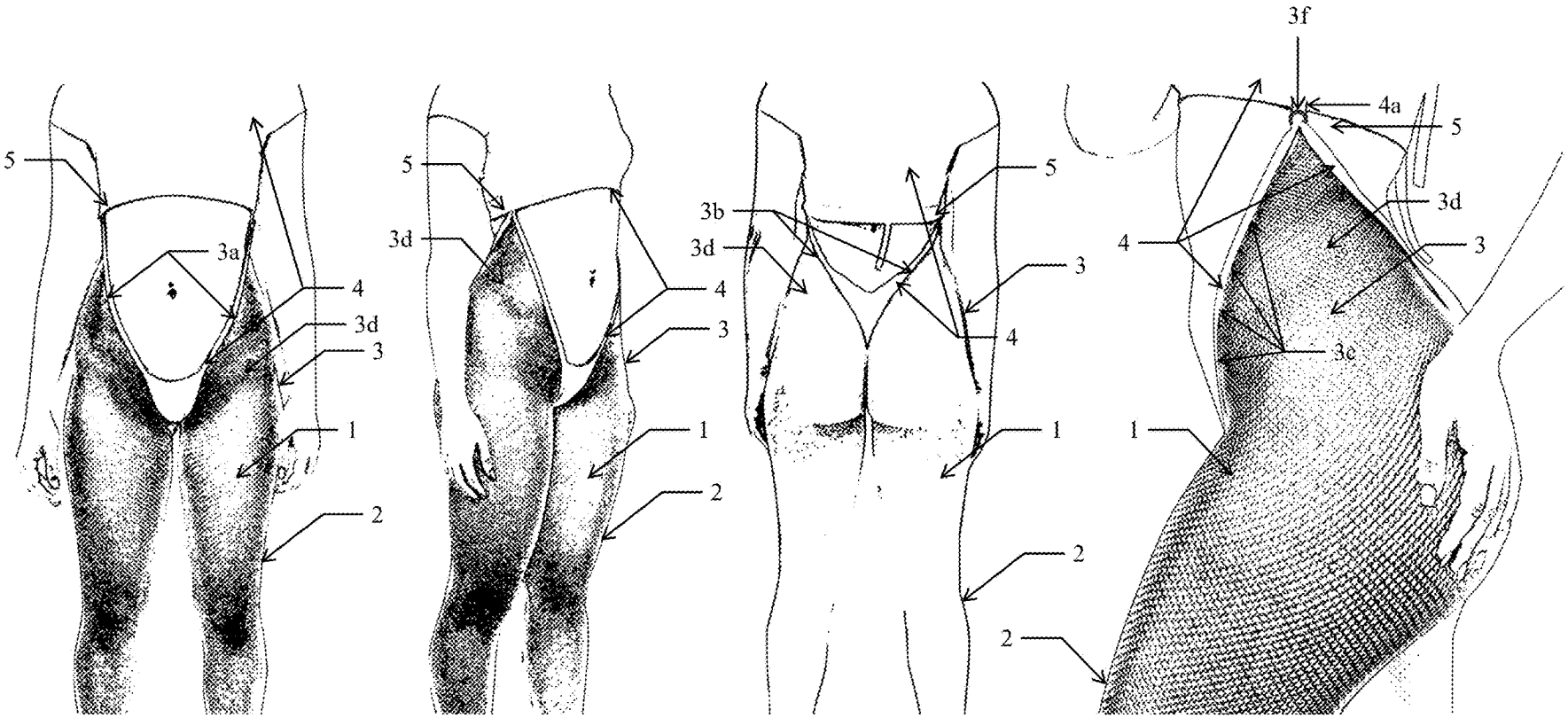
FIG. 2 is a series of views of the present invention on a human figure.

As seen in FIGS. 1-2, the present invention is a carnival pantyhose for use with carnival costumes, configured for improved integration, functionality and reliability. The carnival pantyhose 1 comprises two leg portions 2 that join at a high-rising waistband 3, the high-rising waistband 3 defines a front wedge-shaped cut-out 3*a* and a rear wedge-shaped cut-out 3*b* both extending downward toward the perineal region, and two wedge-shaped lateral portions 3*d* both extending above corresponding hips and upward to a position at or just below the inframammary region 5, each wedge-shaped lateral portion 3*d* terminates in a lateral apex 3*e* that forms an opening 3*f*, the carnival pantyhose 1 is removably attached to the carnival costume 4 by passing a strip 4*a* of the carnival costume 4 through each opening 3*f*, without requiring sewing, stitching, separate fasteners or modifications of the original design of the carnival costume 4. Wherein the carnival pantyhose 1 is configured to span the outer side of the legs, the hips and the lateral sides of the upper torso to the position at or below the inframammary region 5, without obstruction from seams of the carnival pantyhose 1 or from attachments to or elements of the carnival costume 4, and to leave the front and rear sides of the torso corresponding to the front and rear wedge-shaped cut-outs 3*a* 3*b*, respectively, uncovered so as to avoid aesthetic interference with the carnival costume 4. And, wherein the carnival pantyhose 1 is made of a stretchable material that enables conformity to varied body shapes while maintaining positional stability during use.

In an embodiment of the present invention, separate fasteners along a marginal edge 3*c* of the front, rear or both wedge-shaped cut-outs 3*a* 3*b* are provided to reinforce the removable attachment of the carnival pantyhose 1 to the carnival costume 4.

In another embodiment of the present invention, the separate fasteners consist of safety pins.

In another embodiment of the present invention, one or both of the front and rear wedge-shaped cut-outs 3*a* 3*b* have a marginal edge 3*c* that is slightly arcuate.

In yet another embodiment of the present invention, at least one of the openings 3*f* is formed by either a flexible band or a rigid loop.

An advantage of the present invention is that the carnival pantyhose provides improved integration with carnival costumes by combining both its intrinsic design features and removable attachment means. The high-rising waistband with front and rear wedge-shaped cut-outs and the wedge-shaped lateral portions allow the carnival pantyhose to conform closely to the wearer's body while aligning seamlessly with the design of the carnival costume, eliminating the need for sewing, stitching, or other separate fasteners that could interfere with the costume's aesthetics.

Another advantage of the present invention is that the carnival pantyhose is configured to span the outer side of the legs, the hips, and the lateral sides of the upper torso to a position at or below the inframammary region, leaving the front and rear torso areas corresponding to the wedge-shaped cut-outs uncovered. This ensures that the aesthetic appearance of the carnival costume is preserved, avoiding visual or design interference while maintaining a smooth and continuous fit along the covered regions.

Another advantage of the present invention is that the use of a stretchable material allows the carnival pantyhose to conform to varied body shapes, providing comfort and positional stability during wear. This feature ensures that the carnival pantyhose remains in place throughout dynamic movements typical of carnival performances without slipping or shifting.

Another advantage of the present invention is that the optional incorporation of separate fasteners, such as safety pins, along the marginal edges of the wedge-shaped cut-outs provides reinforced attachment points for the carnival pantyhose to the carnival costume. This increases reliability and functionality while offering the flexibility to adapt the carnival pantyhose to different costume designs.

Still another advantage of the present invention is that the openings formed at the lateral apexes of the wedge-shaped lateral portions can be made either with a flexible band or a rigid loop. This allows for customizable attachment methods, balancing flexibility, durability, and ease of use, while further supporting seamless integration with a variety of carnival costume configurations.

The embodiments of the carnival pantyhose herein are exemplary and numerous modifications, combinations, variations, and rearrangements can be readily envisioned to achieve an equivalent result, all of which are intended to be embraced within the scope of the appended claims. Further, nothing in the above-provided discussions of the carnival pantyhose should be construed as limiting the invention to an embodiment or a combination of embodiments. The scope of the invention is defined by the description, drawings, and claims.

What is claimed is:

1. A carnival pantyhose for use with Caribbean and Brazilian carnival costumes, collectively referred to herein as a carnival costume, configured for improved integration, functionality and reliability, the carnival pantyhose comprises:

two leg portions that join at a high-rising waistband, the high-rising waistband defines a front wedge-shaped cut-out and a rear wedge-shaped cut-out both extending downward toward a perineal region, and two wedge-shaped lateral portions both extending above corresponding hips and upward to a position at or just below an inframammary region, each wedge-shaped lateral portion terminates in a lateral apex that forms two openings, the carnival pantyhose is removably attached to the carnival costume by passing a strip of the carnival costume through each opening, without requiring sewing, stitching, separate fasteners or modifications of the original design of the carnival costume;

wherein the carnival pantyhose is configured to span the outer side of the legs, the hips and the lateral sides of the upper torso to the position at or below the inframammary region, without obstruction from seams of the carnival pantyhose or from attachments to or elements of the carnival costume, and to leave front and rear sides of the torso corresponding to the front and rear wedge-shaped cut-outs, respectively, uncovered so as to avoid aesthetic interference with the carnival costume; and wherein the carnival pantyhose is made of a stretchable material that enables conformity to varied body shapes while maintaining positional stability during use.

2. The carnival pantyhose for use with a carnival costume of claim 1, wherein one or both of the front and rear wedge-shaped cut-outs have a marginal edge that is slightly arcuate.

3. The carnival pantyhose for use with a carnival costume of claim 1, wherein at least one of the openings is formed by either a flexible band or a rigid loop.

* * * * *